United States Patent [19]

Pfitzenmaier

[11] 4,180,787

[45] Dec. 25, 1979

[54] FILTER FOR VERY SHORT ELECTROMAGNETIC WAVES

[75] Inventor: Gerhard Pfitzenmaier, Munich, Fed. Rep. of Germany

[73] Assignee: Siemens Aktiengesellschaft, Berlin & Munich, Fed. Rep. of Germany

[21] Appl. No.: 853,530

[22] Filed: Nov. 21, 1977

[30] Foreign Application Priority Data

Nov. 30, 1976 [DE] Fed. Rep. of Germany ..... 2654283

[51] Int. Cl.[2] ..... H01P 7/06; H01P 1/20; H01P 1/16

[52] U.S. Cl. ..... 333/212; 333/227; 333/230

[58] Field of Search ..... 333/73 W, 73 R, 83 R, 333/83 A, 76, 98 R, 70 R, 202, 208, 212, 227, 230

[56] References Cited

U.S. PATENT DOCUMENTS 3,697,898 10/1972 Blachier et al. ..... 333/73 W

FOREIGN PATENT DOCUMENTS 2511800 9/1976 Fed. Rep. of Germany .

OTHER PUBLICATIONS

Lin-"Journal of Applied Physics", vol. 22, No. 8, Aug. 1951; pp. 989-1001.

Williams-"IEEE Transactions on Microwave Theory and Techniques", vol. MTT-18, No. 12, Dec. 1970; pp. 1109-1113.

Atia-"IEEE Transactions on Microwave Theory and Techniques", vol. MTT-22, No. 4, Apr. 1974; pp. 425-431.

Atia et al.-"Narrow-Bandpass Waveguide Filters", in IEEE Trans. on Microwave Theory and Techniques, vol. MTT-20, No. 4, Apr. 1972; pp. 258-265.

Rhodes et al.-In-Line Waveguide Selective Linear Phase Filters in IEEE Trans. on Microwave Theory and Techniques, vol. MTT-22, No. 1, Jan. 1974; pp. 1-5.

Atia et al.-"Non-Minimum Phase, Optimum Amplitude, Bandpass Waveguide Filters", Conference 1973, G-MTT International Microwave Symposium, Digest of Technical Papers, Boulder, Colo., U.S.A., 4-6, Jun. 1973; pp. 210-212.

*Primary Examiner*—Alfred E. Smith
*Assistant Examiner*—Marvin Nussbaum
*Attorney, Agent, or Firm*—Hill, Van Santen, Steadman, Chiara & Simpson

[57] ABSTRACT

A filter for very short electromagnetic waves is disclosed in which a plurality of resonators are formed in a row with each resonator containing two filter circuits. The resonators are operated in a dual mode and the filter circuits are arranged in an electrical sequential manner. First and last filter circuits in a direction of the transmitted energy are provided with input and output lines, respectively. At least one additional coupling is provided between at least two filter circuits which do not directly follow one another in electrical sequential fashion. At least one of the resonators provides two filter circuits which are not adjacent with respect to one another in electrical sequential fashion and are coupled via an additional coupling.

6 Claims, 9 Drawing Figures

FILTER FOR VERY SHORT ELECTROMAGNETIC WAVES

BACKGROUND OF THE INVENTION

The invention relates to a filter for very short electromagnetic waves, consisting of a plurality of resonators forming filter circuits and which are coupled to one another, are operated in the dual-mode, and whose first and last filter circuits in the direction of the transmitted energy are provided with connection lines for the supply and discharge of the electromagnetic energy. An additional coupling is provided between at least two filter circuits which do not directly follow one another in electrical mode of operation and the individual resonators are arranged in the form of rows next to one another.

Filters in micro-wave technology are, as is known, constructed from a plurality of micro-wave resonators which are coupled to one another, the coupling of which can take place either capacitively or inductively. The resonators themselves can consist, for example, of so-called coaxial line resonators or wave guide resonators.

In contrast to filters constructed with concentrated or lumped circuit elements, as a result of the geometrically predetermined configuration of the resonators it is not possible for every circuit which can be constructed in the concentrated technique to be readily transferred to the micro-wave frequency region. This difficulty occurs, in particular, when it is necessary to produce attenuation poles in the attenuation characteristic of the filter and/or a transit time leveling in the pass band of the filter by means of additional couplings of filter circuits. This difficulty is eliminated by means of the arrangement, described in the German OS 1 942 867, of resonators in adjacent rows with additional over-couplings in the common partition wall of two resonators arranged in different rows.

The possibility is also known of constructing micro-wave filters with cavity resonators which are simultaneously operated in more than one mode ("micro-wave filters employing a single cavity excited in more than one mode", "Journal of Applied Physics", Vol. 22, No. 8, August 1951 by Wei-Guan Lin; "A Four Cavity Elliptic Waveguide Filter", "IEEE Transactions on Microwave Theory and Techniques", Vol. -MTT. 18, No. 12, December 1970 by Williams, A. E.). Here preferably two identical but orthogonal loads are employed in $H_{101}$- or $H_{111}$- resonators and are coupled to one another by means of a coupling screw arranged at 45° to the direction of the E-vectors (dual mode). In this way two electric oscillating circuits of a filter can be constructed in a technically effective fashion in one single cavity resonator. On account of the reduction in weight and volume of up to 50%, an important field of application consists in satellite technology, particularly since high electrical requirements are made on the filters employed therein which become manifest in a relatively large number of electric oscillating circuits.

As these filters also require attenuation poles and/or a leveling of the transit time in the pass band, it is obviously desirable to find suitable filter circuits in the dual mode technique for this purpose. In this connection a proposed construction is known ("Nonminimum-Phase Optimum-Amplitude Band pass Waveguide Filters", "IEEE Transactions on Microwave Theory and Techniques", Vol. MTT-22, No. 4, April 1974 by Atia, A. E. and Williams, A. E.), which, however, is restricted to filter circuits which are symmetrical both with respect to structure and with respect to element values. Furthermore they exhibit additional couplings which frequently overlap, and cannot be preselected with respect to number and geometric position within the filter arrangement. Also, the number of electric oscillating circuits of the filter circuits must amount to a multiple of 4 so that this proposal frequently cannot be practically realized.

A possibility of improving the realizability of filter circuits which are asymmetrical, particularly with respect to element values and which can be operated in the dual mode has been disclosed by the German OS 2 511 800 and consists in arranging the resonators in adjacent rows and providing a different number of resonators in the rows.

The coupling of filter circuits in spatially different resonators is subject to the condition that the relevant two filter circuits should be spatially orientated in like manner, so that e.g. their E vectors run parallel with one another. This condition restricts the number of theoretically conceivable couplings and thus the spectrum of possible realizations or permits realizations only without the use of additional couplings, which in themselves are desirable, or only with production technology disadvantages.

SUMMARY OF THE INVENTION

An object of the invention is to overcome the above-mentioned difficulties in a simple fashion, and, in particular, to provide practical filter circuits with resonators operated in the dual mode and additional couplings which, in the previously known above-mentioned arrangements, either are not possible or are possible only with considerable disadvantages.

According to the invention, a filter for very short electromagnetic waves is provided consisting of a plurality of resonators with filter circuits and which are coupled to one another, are operated in the dual mode, and whose first and last filter circuits in the direction of the transmitted energy are provided with connection lines for the supply and discharge of the electromagnetic energy. An additional coupling is provided between at least two filter circuits which do not directly follow one another in the electrical mode of operation and the individual resonators are arranged next to one another in the form of rows. In accordance with the invention, two filter circuits which are not adjacent in counting mode and which are coupled via an additional coupling are provided by means of at least one resonator.

The invention is based upon the recognition that in the previously known arrangements, the source of the circuitry limitations is that two filter circuits which are consecutive in counting mode are always assigned to the same dual mode resonator.

A particular advantage of the invention is that the limitations concerning the circuit structure which exist in the known prior art are avoided so that consequently the number of filter circuits which can be constructed in the dual mode is considerably increased.

A production technology advantage in comparison to known filters is that the filter structures which, in accordance with the prior art must be constructed with two or more adjacent resonator rows, are constructed in accordance with the invention in one row and the individual resonators can thus be assembled in a simple manner by means of flange connections.

DESCRIPTION OF THE PREFERRED EMBODIMENTS

Figure 1:
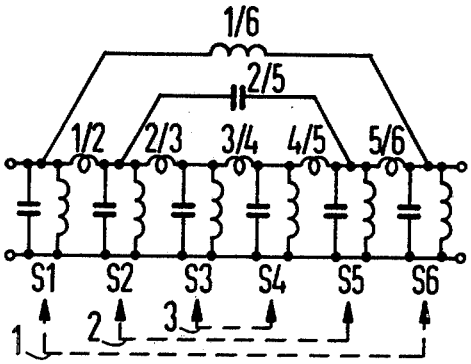
FIG. 1 illustrates a six circuit filter arrangement with two additional over-couplings.

FIG. 1 is an equivalent circuit of a six circuit Cauer bandpass filter with concentrated or lumped circuit elements. This is a four-pole circuit, in the shunt arms of which are arranged the parallel oscillating circuits S1 to S6, and which are coupled via the coupling inductances 1/2, 2/3, 3/4, 4/5 and 5/6 arranged in the series arms. By way of additional coupling, a coupling inductance 1/6 is introduced between the parallel oscillating circuits S1 and S6, and a coupling capacitance 2/5 is introduced between the parallel oscillating circuits S2 and S5.

It has hitherto been impossible to construct a bandpass filter of this kind by means of dual-mode resonators arranged next to one another in a row, since, for example, in an experiment on a construction employing $H_{101}$ resonators, the E vectors of the filter circuits S1, S6 and S2, S5 are arranged orthogonally to one another and thus cannot be coupled via coupling slots in a resonator wall.

For this reason previously only "pseudo-Cauer filters" of the n=6 order have been known, for example having been disclosed in the article "Prototype characteristics of a class of dual-mode filters" by R. D. Wanselow, published in IEEE Transactions on Microwave Theory and Techniques of August 1975. These filters only possess one attenuation pole above and below the pass band and thus are not optimal.

Figure 2:
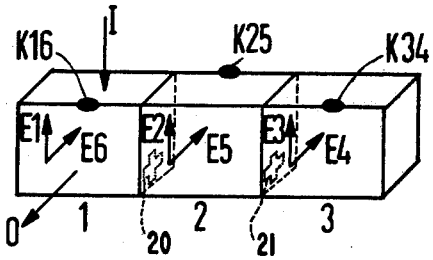
FIG. 2 illustrates a filter arrangement in accordance with the invention for the realization of the circuit shown in FIG. 1.

In the exemplary embodiment illustrated in FIG. 2, a filter arrangement in accordance with the invention is illustrated which consists of three cavity resonators 1 to 3, and whose physical equivalent circuit diagram is the circuit in FIG. 1. Here the resonators are arranged in one row in such manner that resonators arranged next to one another in each case possess a common partition wall. The coupling elements which serve to couple the resonators operated in the dual-mode are designed in known manner, for example in accordance with the arrangement in FIG. 2 of German Os 2 511 800, as slot openings and as shown in the instant case at 20 and 21 in FIG. 2.

The E vectors assigned to the individual modes are orthogonal within a resonator and in FIG. 2 are provided with the references E1 to E6 in accordance with the associated parallel oscillating circuits S1 to S6 in FIG. 1. Each of the resonators is furthermore provided with a coupling screw K16, K25 and K34 arranged at an angle of 45° between the E vectors corresponding to the modes, in order to set the coupling between the orthogonal modes operated therein. In the prior art, coupling screws of this kind served merely to produce the coupling inductance between two adjacent parallel oscillating circuits of the equivalent circuit diagram, which thus followed one another in counting mode. In accordance with the invention, the exemplary embodiment illustrated in FIG. 2 contains at least one resonator, however, and in a special situation the two resonators 1 and 2, which are assigned the filter circuits S1, S5 and S2, S5, which do not follow one another in counting mode, and therefore the coupling screws also produce additional coupling reactances between non-adjacent filter circuits.

In detail, in the exemplary embodiment, the resonator 1 is assigned the filter circuits S1 and S6 and the corresponding E vectors E1 and E6, the coupling of which is effected via the coupling screw K16 which has an inductive action. In this way the resonator 1 simultaneously contains the input-coupling terminal I and the output-coupling terminal O of the filter. The resonator 2 which adjoins the resonator 1 by a common partition wall is assigned the filter circuits S2 and S5 and the corresponding, orthogonal E vectors E2 and E5. The coupling of these filter circuits is effected via the coupling screw K25 which is arranged to be offset relative to the coupling screw K16 by a resonator edge, and thus produces a capacitive coupling.

The coupling of resonator 1 to resonator 2, and of their assigned modes with the corresponding, in each case parallel E vectors E1, E2 and E6 is effected via coupling slots which are arranged in the common partition wall of these resonators in each case at right angles to the E vectors E1, E2 and at right angles to E6, E5, and which are shown at 20 and 21 in FIG. 2.

The resonator 3 which adjoins the resonator 2 is assigned the filter circuits S3 and S4, represented by the corresponding orthogonal E vectors E3 and E4, the inductive coupling of which is effected via the coupling screw K34. The coupling of resonator 2 to resonator 3 is effected via further coupling slots which are arranged in the common partition wall of these resonators at right angles to the relevant E vectors E5, E4 and E2, E3 and which have not been represented in the Figure.

In order to indicate the division of the oscillating circuits between the individual resonators in the exemplary embodiment, the circuit illustrated in FIG. 1 is provided with broken coordination lines which run between two oscillating circuits constructed in a resonator and are provided with the references assigned to the relevant resonator.

Figure 3:
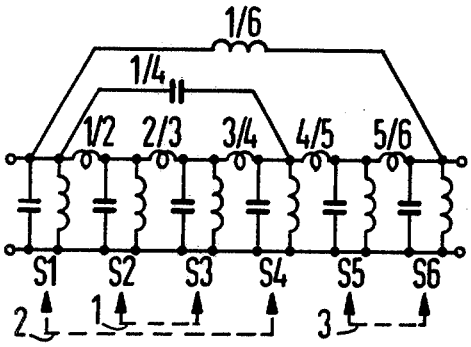
FIG. 3 illustrates another six circuit filter arrangement with two additional over-couplings.

An exemplary embodiment of the invention for a six-circuit Cauer filter consists in a further equivalent circuit which is suitable for construction in dual-mode technology and which is represented in FIG. 3. This again is a four-pole circuit with parallel oscillating circuits S1 to S6 in the shunt arms which are coupled via coupling inductances 1/2 to 5/6. In place of the additional coupling 2/5 in accordance with FIG. 1, however, a capacitive, additional coupling 1/4 has been introduced which runs between the oscillating circuits S1 and S4.

Figure 4:
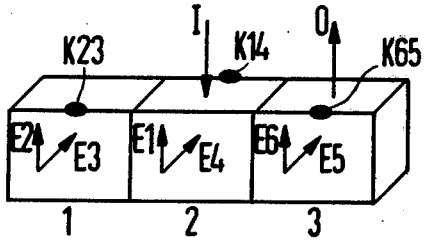
FIG. 4 illustrates a further filter arrangement in accordance with the invention for the realization of the circuit shown in FIG. 3.

The individual oscillating circuits have again been divided between the resonators in the exemplary embodiment in FIG. 4 in accordance with the coordination lines of FIG. 3. In accordance with the invention, the filter illustrated in FIG. 4 contains a resonator, here the resonator 2, which is assigned the filter circuits S1 and S4 which do not follow one another in counting mode and are represented by the E vectors E1 and E4, whereas the resonator 1 contains the filter circuits S2 and S3 and the resonator 3 contains the filter circuits S5 and S6.

In the resonator arrangement illustrated in FIG. 4, the electric vectors E1 and E6 of the filter circuits S1 and S6 run parallel to one another and can thus be magnetically coupled by means of a slot in the partition wall of the resonators 2 and 3. The capacitive additional coupling of the filter circuits S1 and S4 is achieved in that the dual-mode coupling screw K14 of the resonator 2 is displaced by 90° relative to the like-orientated coupling screws K23 and K65 of the resonators 1 and 3.

In comparison to the exemplary embodiment in FIG. 2, the arrangement in FIG. 4 has the advantage that the input-coupling terminal I and the output-coupling terminal O of the filter are not contained in the same resonator, but in the resonators 2 and 3. This largely avoids the occurrence of undesired additional couplings.

Figure 5:
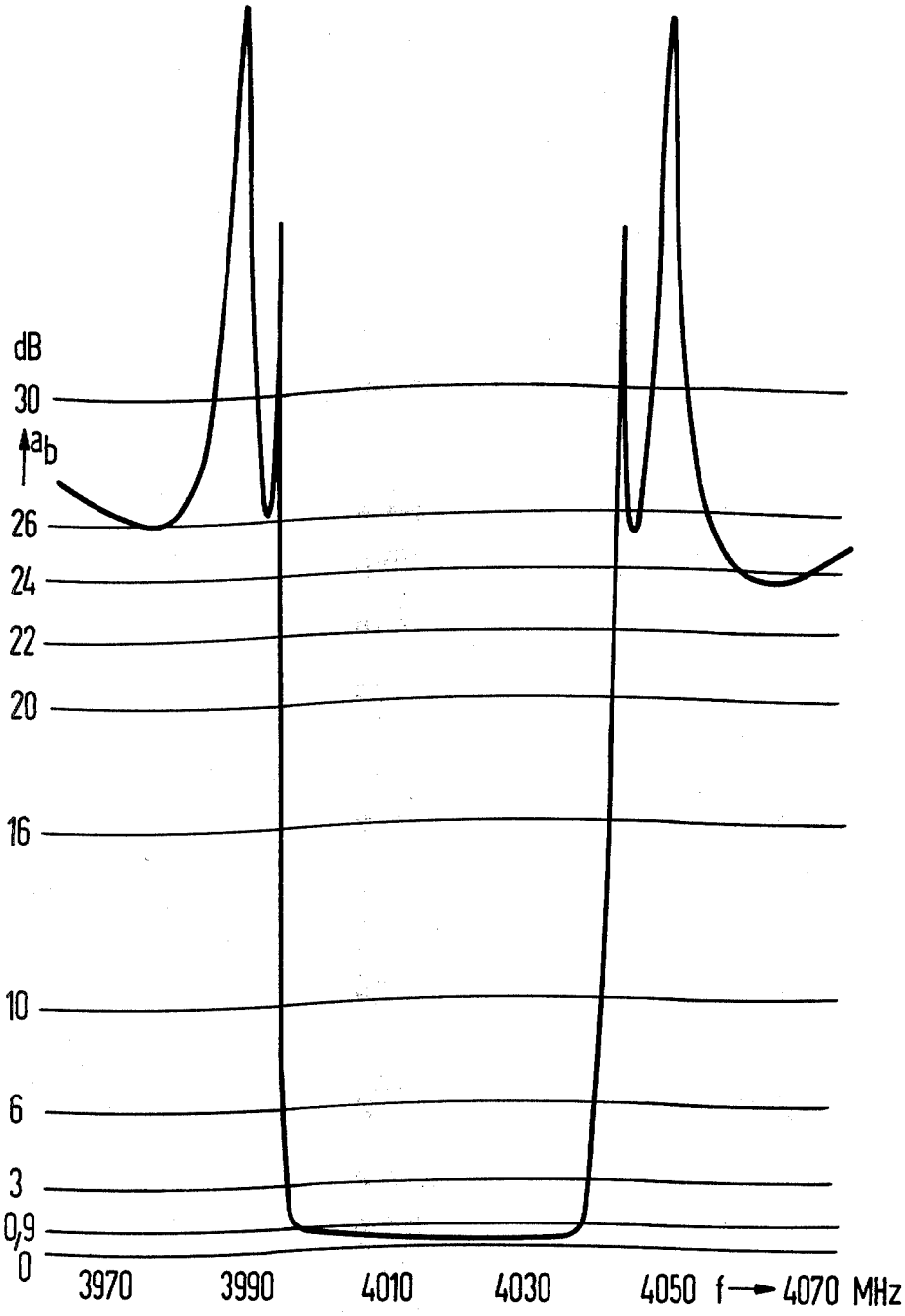
FIG. 5 is a measured curve of the operating attenuation variation of a filter arrangement constructed in accordance with the invention.

FIG. 5 shows a measured curve of the operating attenuation variation, which complies well with theory, of the exemplary embodiment as shown in FIG. 4. This is a band-pass filter which has been derived from the Cauer low-pass filter C6/26 dB/25 dB/B by transformation, and is operated with $H_{101}$ dual mode resonators. (Theoretical data: middle frequency $f_o=4015$ MHz, pass band width $\Delta fg=40$ MHz, echo attenuation $a_e \geqq 26$ dB, blocking attenuation $a_b \geqq 25$ dB). The two clearly marked attenuation poles in each case beneath and above the pass band can be gathered from the measured curve. For the echo attenuation, values of $a_e \geqq 21$ dB were measured in the required pass band.

A realization with dual-mode resonators for the eight-circuit Cauer band-pass filter with in each case three attenuation poles below and above the pass band has not been previously known. The article "Narrow Band-Pass Waveguide Filters" by A. E. Atia and A. E. Williams in "IEEE Transactions on Microwave Theory and Techniques", Vol. -MTT 20, No. 4, April 1972 only reports on a "Pseudo Cauer Filter" of the n=8 order, with only in each case two attenuation poles below and above the pass band.

Figure 6:
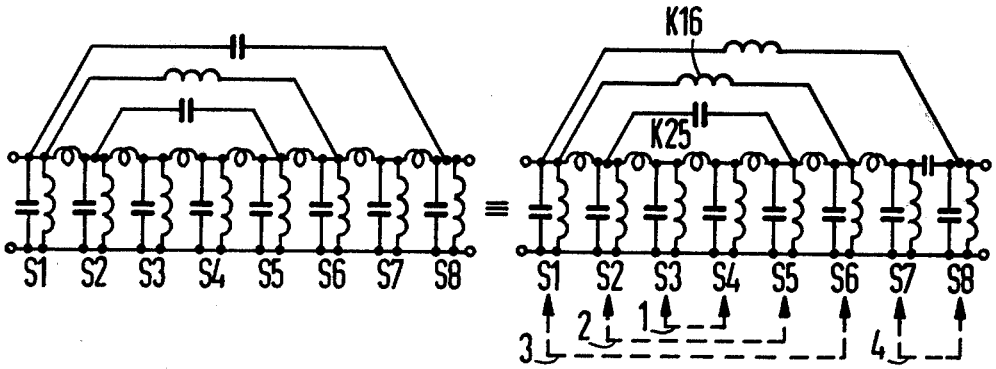
FIG. 6 illustrates two equivalent circuits of an eight-circuit filter arrangement with three additional over-couplings.

FIG. 6 illustrates two equivalent circuits of the Cauer band-pass filter of the n=8 order with concentrated elements. The second circuit, provided with an inductive additional coupling K16, can be constructed in accordance with the invention in the dual-mode technique and is illustrated in the exemplary embodiment shown in FIG. 7.

Figure 7:
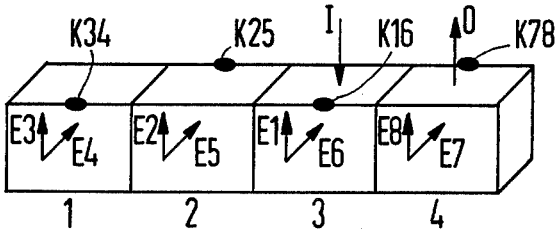
FIG. 7 illustrates a further filter arrangement in accordance with the invention for the realization of the circuits shown in FIG. 6.

The filter in FIG. 7, which is constructed from the resonators 1 to 4 contains the two resonators 2 and 3, which accommodate the filter circuits S2, S5 and S1, S6 which do not follow one another in counting mode. The sign sequence for the additional couplings which has been used in accordance with the associated equivalent circuit diagram can be achieved with the locations shown in FIG. 7, of the dual-mode coupling screws K34, K25, K16 and K78.

Figure 8:
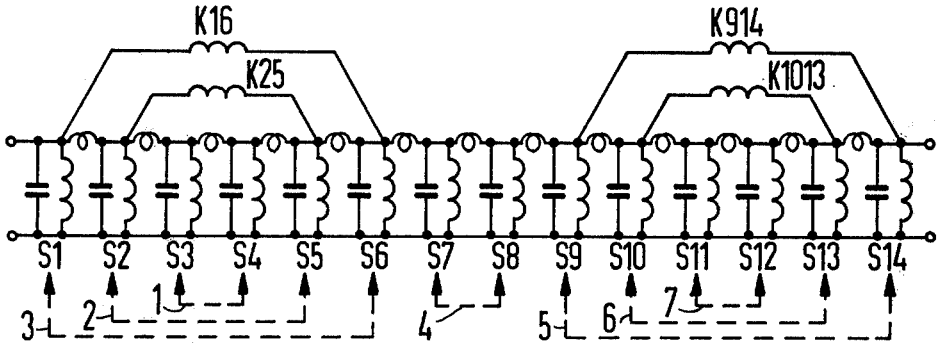
FIG. 8 illustrates a fourteen circuit filter circuit arrangement with four additional over-couplings.

An advantageous application of the invention consists, for example, also in the construction of a fourteen-circuit linear filter, of which the equivalent circuit diagram is represented in FIG. 8, and which contains two circuit sections in each case double-bridged for transit time leveling in the pass band. The additional couplings are entirely inductive and run between the circuits S1 and S6 (K16), S2 and S5 (K25), S9 and S14 (K914), and S10 and S13 (K1013).

Figure 9:
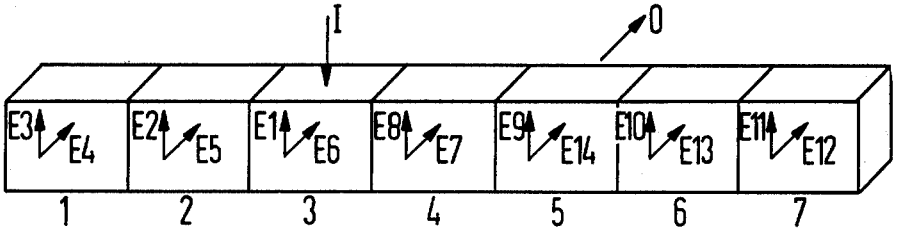
FIG. 9 illustrates a filter arrangement in accordance with the invention for the realization of the circuit shown in FIG. 8.

As can be seen from the resonator arrangement in accordance with the invention shown in FIG. 9 and having the equivalent circuit of FIG. 8, the resonator arrangement consists of the resonators 1 to 7. Filter circuit pairs S1, S6; S2, S5; S9, S14; and S10, S13 comprise filter circuits which do not follow one another in counting mode and are in each case combined in a resonator, the resonators 3, 2, 5 and 6, respectively. An advantage with respect to production technology in comparison to known arrangements of this type consists in that the resonators are arranged in one single row and thus can be easily assembled by means of flange connections. An electrical advantage is achieved in particular by the splitting of a 4 bridge circuit section into two double bridged circuit sections as this results in dimensions for the coupling slots which can be more easily achieved and simplifies the filter tuning.

Although various minor modifications may be suggested by those versed in the art, it should be understood that I wish to employ within the scope of the patent granted hereon all such modifications as reasonably and properly come within the scope of my contribution to the art.

Iclaim as my invention:

1. A micro-wave filter comprising: a plurality of sequentially connected filter circuits; a plurality of resonators, each resonator operating as two of said filter circuits, said resonators operating in a dual mode; individual resonators of said plurality being arranged next to one another in a row; the filter circuits all being coupled in a predetermined sequential mode of electrical operation; first and last filter circuits being provided with connection line means for input and output of micro-waves, respectively; all sequentially adjacent resonators having coupling means therebetween for coupling the micro-waves therebetween without mode change; and at least one resonator providing two filter circuits which are not directly adjacent in the sequential mode of electrical operation and are coupled via an additional coupling.

2. A filter as claimed in claim 1, in which the resonators, filter circuits and couplings form a six-circuit Cauer band-pass filter, the resonators being arranged in one row, and two resonators are provided, each of which have two filter circuits which are not adjacent in counting mode and are coupled via an additional coupling.

3. A filter as claimed in claim 1, in which the resonators, filter circuits, and couplings form an eight-circuit Cauer band-pass filter, the resonators being arranged in one row, and three resonators are provided each of which have two filter circuits which are not adjacent in counting mode and are coupled via an additional coupling.

4. A filter as claimed in claim 1 in which the resonators, filter circuits, and couplings form a fourteen-circuit linear phase filter, the resonators being arranged in one row and four resonators are provided, each of which have two filter circuits which are not adjacent in counting mode and are coupled via an additional coupling.

5. The filter of claim 1 in which said additional coupling is a coupling screw.

6. The filter of claim 1 in which three resonators are provided in row form and two of the resonators each have one of said additional couplings.

* * * * *